United States Patent [19]

Bloomfield

[11] 4,133,319

[45] Jan. 9, 1979

[54] CAN SUPPORTED ASHTRAY

[76] Inventor: Ellis L. Bloomfield, Box 278, Hector, Minn. 55432

[21] Appl. No.: 769,706

[22] Filed: Feb. 17, 1977

[51] Int. Cl.[2] ..... A24F 19/00; A24F 19/10

[52] U.S. Cl. ..... 131/241; 30/407; 131/242; 220/1 BC; 220/85 R; 222/83.5

[58] Field of Search ..... 131/231, 235 R, 236, 131/238, 241, 240 R, 242; 220/DIG. 19, 1 H, 13, 16, 15, 1 BC, 85 SP, 85 H, 85 R, 90.2, 90.4, 90.6; 30/403, 411, 414, 443; 222/86, 83.5

[56] References Cited

U.S. PATENT DOCUMENTS

| | | | |
|---|---|---|---|
| 2,152,285 | 3/1939 | Schirmer | 131/242 |
| 2,158,770 | 5/1939 | Barlett | 131/241 |
| 2,676,732 | 4/1957 | Greenwood | 222/86 |
| 2,746,645 | 5/1959 | Knäbec | 222/86 |
| 2,881,952 | 4/1959 | Dungy | 222/86 |
| 3,082,901 | 3/1963 | Nakagawa | 131/242 |
| 3,522,812 | 8/1970 | Chism | 131/242 |
| 3,620,225 | 11/1971 | Bailey | 131/235 R |
| 3,730,399 | 5/1973 | Dibrell et al. | 220/90.4 |

*Primary Examiner*—Robert W. Michell
*Assistant Examiner*—V. Millin
*Attorney, Agent, or Firm*—Clayton R. Johnson

[57] ABSTRACT

An ash receiver device removably mountable on a used beverage can to provide an ashtray. The ash receiver device includes a central punch portion that is in part extendable into an off center hole normally provided in the can to dispense beverage therefrom, and in being forced downwardly shears or cuts an enlarged central opening in the can top. A frusto conical portion is joined to the punch portion for directing ashes into the punch portion bore, the frusto conical portion being joined to a can mounting and guide portion that aids in properly positioning the punch portion and prevent tipping of the can as a hole is being punched.

20 Claims, 4 Drawing Figures

CAN SUPPORTED ASHTRAY

BACKGROUND OF THE INVENTION

An ash receiver device mountable on a beverage can to provide an ashtray.

In the prior art it is old to provide a combination drinking rim and can opener mountable on a can, see for example U.S. Pat. No. 2,881,952. Also it is old to mount an ash receiver device on beverage cans that have openings provided in the top thereof prior to the mounting of said device wherein ashes can fall through the existing openings, for example see U.S. Pat. Nos. 2,152,285; 2,158,770; 3,522,812 and 3,620,225. With these prior devices a previously existing opening has to be used, or else a non-centrally located opening used which is not the most desirable.

SUMMARY OF THE INVENTION

An ash receiver device mountable on an emptied beverage can that has a central punch portion that is in part extendable into an off center hole in the can top and movable to punch a central opening in can top, a frusto conical portion joined to the punch portion to direct ashes into the central bore through the punch portion and an annular flange joined to the frusto conical portion to aid in properly positioning the punch portion relative the can top and preventing the can from tipping as the central hole is punched.

One of the objects of this invention is to provide a new and novel ash receiver device for punching a hole in a can top and directing ashes through said hole. In furtherance of the above object, it is another object of this invention to provide an ash receiver device that uses the existing hole in the can to facilitate punching a centrally located hole in a can top. Another object of this invention is to provide a new and novel ash receiver having a punch portion that securely locks the receiver device on the can and at the same time permits the receiver being removed by a twisting action while exerting a lifting force. A still further objection of this invention is to provide a new and novel ash receiver and beverage can combination that when having some liquid in the can is nearly spill proof if it is accidentally knocked over.

An off-center dispensing opening referred to herein is one where the beverage dispensing opening is entirely spaced from the can top center, or at most only a small part of the opening is adjacent the can top center, for example such as shown in FIG. 4, in contrast to an opening having its center located substantially at the can top center.

Figure 1:
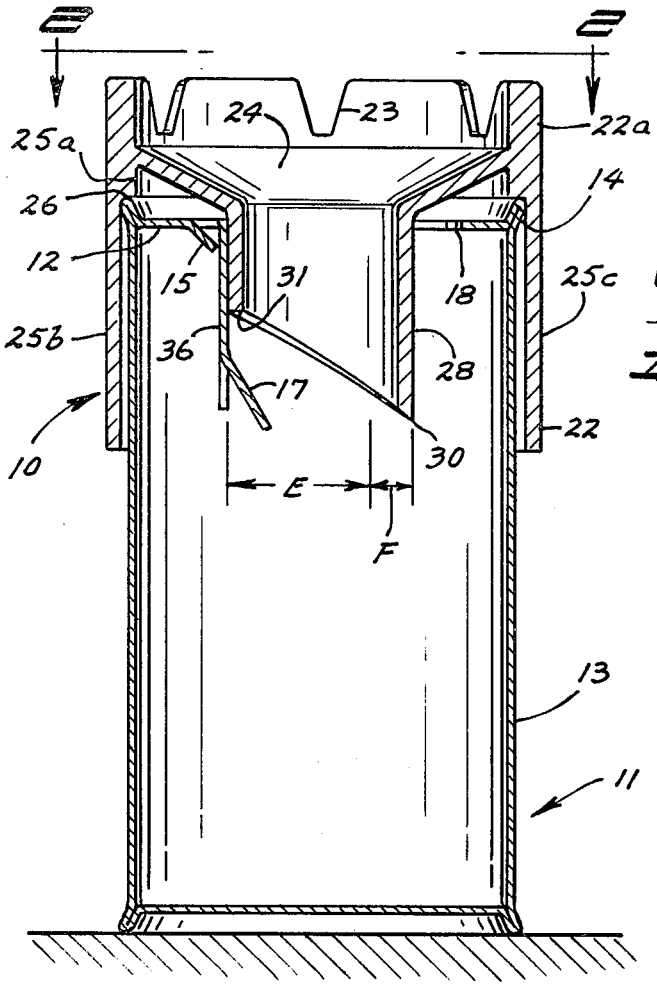
FIG. 1 is a vertical cross sectional view of the ash receiver device of this invention and a beverage can forming an ash tray, said view being generally taken along the line and in the direction of the arrows 1—1 of FIG. 2.
Figure 2:
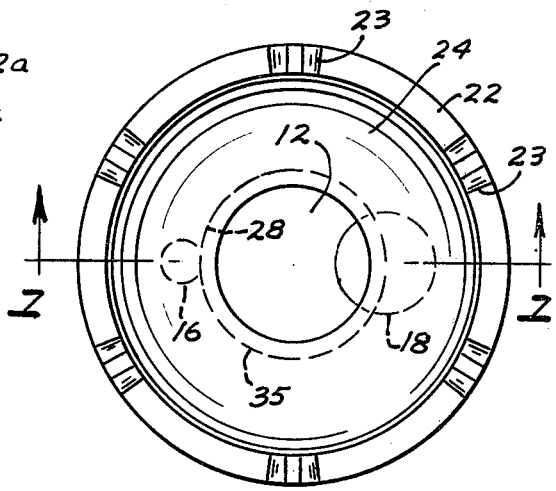
FIG. 2 is a plan view generally taken along the line and in the direction of the arrows 2—2 of FIG. 1 other it is shown just prior to the ash receiver device being pushed down to punch a hole in the can.
Figure 3:
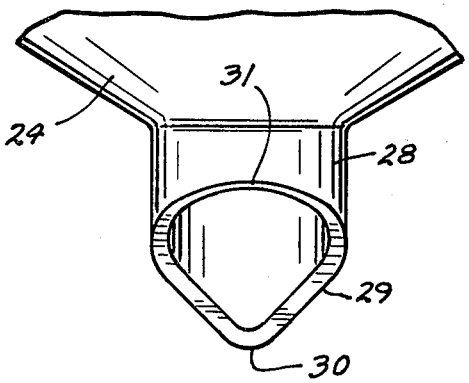
FIG. 3 is a fragmentary side view of the punch portion of the ash receiver device.

Referring now to the FIGS. 1-3, the ash receiver device, generally designated 10, is removably mountable on a used conventional beverage can, generally designated 11, that has one or more off-center preweakened areas on the can top 12 to permit a dispensing opening being provided without the use of a can opener or other device. The particular can illustrated in FIGS. 1 and 2 has a top 12 that is joined to the can cylinder 13 at a peripheral bead or seam 14 so that the top is at a lower elevation than the top of the bead. The top has a conventional generally circular pressure release tab or button 15 that is joined to the remainder of the top by a weakened metal part so that button can be manually pressed down to provide a pressure release opening 16 while one edge portion of the button remains integrally joined to the remainder of the top. On the diametric opposite side of the top from button 15 there is provided a substantially larger, generally circular tab or button 17 that is joined to the remainder of the top in a manner corresponding to that set forth relative button 15. Manually pressing down on button 17 provides a beverage dispensing opening 18; the edge portion of button 17 that remains joined to the remainder of the top being radially adjacent the center of the top, but radially offset therefrom. The openings 16 and 18 are each located at a substantial minimum spacing from each of the bead 14 and the center of the top and from each other.

The ash receiver device includes an annular can mounting portion 22 that is of a substantial axial length. The upper part **22*a* of portion 22 is provided with a plurality of tapered slots 23 for holding cigarettes or cigars. A frusto conical portion 24 has its outer edge joined to the inner peripheral wall of mounting portion 22 below the bottom edges of slot 23**. The frusto conical portion has upper and lower surfaces that are inclined upwardly and radially outwardly at a substantial angle, for example about 25°.

Below the frusto conical portion the mounting portion has an upper bore portion **25*a* and a lower bore portion 25*b* that is of a larger diameter than bore portion 25*a* whereby at the juncture of bore portions 25*a*, 25*b* there is formed an annular shoulder 26. The diameter of bore portion 25*a* is smaller than the inner diameter of the upper part of the bead while the diameter of bore portion 25*b* axially closely adjacent the bead is only slightly larger than the maximum diameter of bead 14. Shoulder 26 is provided for bearing against the top of bead 14. The lower end of frusto conical portion 24 is at a lower elevation than shoulder 26 by an axial distance that is less than the maximum axial distance that the bead 14 extends above the top 12. The axial length of bore portion 25*a* is many times greater than the axial length of bore portion 25*b*. The part of the mounting portion having bore portion 25*b* constitutes an annular flange 25*c* that is substantially concentric with an annular punch portion 28**.

The punch portion 28 is joined to the lower end of the frusto conical 24 to extend axially downwardly therefrom. Punch portion 28 is provided with a lower terminal cutting edge 29 that throughout its arcuate length is tapered radially inwardly and upwardly. Additionally the cutting edge has a part 31 that is of a minimum axial spacing from frusto conical portion 24 and a part 30 on the diametric opposite side of the punch portion that is of a maximum spacing from the frusto conical portion. From part 30 in both angular directions, the cutting edge along a dimension E is tapered downwardly at one angle, for example about 60° to vertical and along a dimension F at a sharper angle, for example about 45° to the vertical.

The inner and outer radii of curvature of the punch portion at the upper end thereof are slightly larger than the inner and outer radii of curvature of the lower part of the punch portion. Thus the wall defining the punch portion along the axial length thereof and around its entire periphery is tapered inwardly in a downward direction to lock and punch portion to the can when it punches a hole in the can but permit withdrawal thereof upon twisting and lifting the punch portion. Advantageously, the maximum diameter of the punch portion is at 40% of that of the inner diameter of the mounting portion 22.

The upper part 31 of the cutting edge is axially about midway between the shoulder 26 and the lower, annular terminal edge of the mounting portion 22 while said lower edge is axially more remote from said shoulder than the lower part 30.

In using a beverage can the push buttons are pushed to provide openings 16, 18, or the manually operated tab on the beverage can top is manipulated to provide a radially elongated, somewhat rain drop shaped dispensing opening as in conventional. After the contents have been dispensed from the can, the ash receiver device is positioned above the emptied can and rotated relative to the can so that the lower pointed part 30 of the punch portion extends at least partially into the can top dispensing opening. At this time the mounting portion lower part surrounds and extends below the bead 14 which serves to center the receiver device relative the can top. Now the device 10 is pushed downwardly which cuts or sheers the can top along parts thereof that are progressively further from the dispensing opening and bends the part of the can top severed from the outer circumferential part of the can top downwardly and generally horizontally toward opening 16. As the punch portion is moved further downwardly the cutting edge part 31 engages the can top and then pushes the part of the can top engaged by edge 29 to sever it from the outer circumferential portion of the can top to provide a central opening 35 in the can top and a cut out portion 36 that is deflected to the side of the punch portion. If the can is of the construction of FIGS. 1 and 2, the button 17 will be joined to the cut out portion 36. Due to the slight taper of the punch portion, in pushing the device 10 down, the edge of the can top defining the central opening 35 forms a tight friction fit with the punch portion to lock the receiver device to the can which would require a relatively large force to separate the device from the can just by pulling. However, the device can be relatively easily separated from the can by twisting the device relative the can and at the same time pulling on the device. Due to the part 30 being initially extended into hole 18, the severing of portion 36 is much easier than if the punching action were initially on an unperforated part of the can top.

Figure 4:
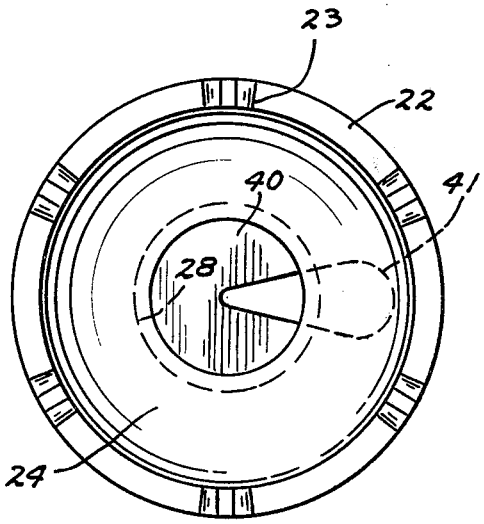
FIG. 4 is a view that corresponds to FIG. 2 other it shows a can having a different type of can top dispensing opening.

Referring to FIG. 4, the ash receiver device is shown centered relative a beverage can having a can top 40 in a position just immediately prior to the punch portion 28 being pushed down to cut a hole in the can top. The can top 40 has a conventional radially elongated beverage can off-center dispensing opening 41 that is somewhat rain drop shaped. The opening 41 in part is formed in the center part of the can top and is of larger transverse widths radially outward of the can center whereby nearly the entire part of the opening is off-center relative the can top center. The cutting edge part 30 is extended into opening 41 prior to the ash receiver device being pushed down to form the central opening in the can top. The part of the can top punched out and deflected to the side by the punch portion will include only part of the can top that defines opening 41.

In a position of use the shoulder 26 abuts against the bead 26. As a result, if a small amount of water is put in the can and the can is accidentally tipped and then uprighted, at most only a small portion of the water would spill by seeping between the bead and the shoulders. To prevent this seepage, if any, advantageously a resilient gasket (not shown) could be adhered to shoulder 26. Further, due to the punch portion being of a substantially smaller diameter than the can, and around its entire periphery extending a substantial distance axially inwardly of the can top, ashes or water will not spill easily if the ash tray is knocked over.

The tapered upper surface of the frusto conical portion permits ashes to gravitate into the can and also provides a surface against which cigarettes may be extinguished. Also the bore through the frusto conical and punch portions is sufficiently large that cigarettes or cigars may be dropped therethrough.

The ash receiver device may be made of, for example, metal or phenolic or melamine plastic materials; and may be made as a single integrally joined piece by, for example, molding. As an example of the invention but not otherwise as a limitation thereof, the radius of the bore through the frusto conical portion may be about 0.5", the inside radius of curvature of the lower part of the punch portion about 0.4687", the wall thickness of the punch portion about 0.125", the axial length of the mounting portion below the shoulder about 1.5625", and the maximum and minimum axial distances that the punch portion extends below the shoulder respectively 1.50" and 1.4375".

What is claimed is:

1. An ash receiver device for a beverage can or the like that has a top off center dispensing opening, comprising an annular mounting and guiding portion having an axially upper end portion and an axially lower terminal edge, an annular punch portion having an upper portion and a lower axially tapered cutting edge, and a frustoconical portion extending between and joined to the guiding portion and the punch portion for mounting the punch portion on the guiding portion in generally transverse centered relationship thereto with the guiding portion at least partially surrounding the punch portion, the punch and frustoconical portions having a bore extending therethrough, and the frustoconical portion having an upper surface surrounding said bore that is tapered downwardly toward said bore.

2. The apparatus of claim 1 further characterized in that the guiding portion has a bore extending from the frusto conical portion to its lower terminal edge, the guiding portion bore having an upper bore portion and a lower bore portion of a larger diameter than its upper bore portion to form an annular downwardly facing shoulder.

3. The apparatus of claim 2 further characterized in said shoulder is at an elevation axially intermediate the juncture of the frusto conical portion to the guiding portion and the juncture of the frusto conical portion to the punch portion.

4. The apparatus of claim 1 further characterized in that punch portion has an outer diameter that is at least 40% of an inner diameter of the guiding portion below the frusto conical portion.

5. In combination, a beverage can that includes a peripheral top bead and a can top having an off-center dispensing opening portion and a generally central opening that opens directly to the off-center opening portion, and an ash receiver device having a punch portion extending through the central opening and in abutting relationship to can top, said punch portion having an opening therethrough that opens into the can, and means abutting against the bead and joined to the punch portion for receiving ashes and directing ashes to the punch portion opening.

6. The apparatus of claim 5 further characterized in that the bead is annular and that said means includes a tapered surface portion surrounding and joined to the punch portion to extend away therefrom in an upward direction above the can top.

7. The apparatus of claim 6 further characterized in that said can has a bottom and that said means includes an annular flange that extends around the can and has a lower annular terminal edge that is vertically between the can top and bottom.

8. The apparatus of claim 6 further characterized in that said punch portion has a lower terminal, annular cutting edge that is entirely located a substantial distance below the can top.

9. The apparatus of claim 8 further characterized in that the cutting edge has an upper part and a lower part diametrically opposite the lower part that is at a substantially lower elevation than the upper part and that the annular flange lower terminal edge is at a lower elevation than the cutting edge.

10. The apparatus of claim 8 further characterized in that the first mentioned means has an annular shoulder below the tapered surface portion abutting against said bead and that the annular flange is of a diameter only slightly larger than the maximum diameter of the bead.

11. The apparatus of claim 5 further characterized in that the bead extends to a higher elevation than the can top and that said tapered surface portion is frusto conical and has an outer periphery, and that said means includes an annular portion joined to the frusto conical outer periphery and extending thereabove.

12. In combination, a beverage can that includes a peripheral top bead having a bead top and a can top at a lower elevation than the bead top, said can top having an opening, and an ash receiver device having a punch portion extending through the can top opening and in abutting relationship to the can top, said punch portion having an opening therethrough that opens into the can, and means abutting against the bead and joined to the punch portion for receiving ashes and directing ashes to the punch portion opening, the above mentioned means including an upper portion having a slot for holding a cigarette, a tapered surface portion surrounding and joined to the punch portion to extend away therefrom in an upward direction above the can top for directing ashes toward the punch portion opening and means joined to the tapered surface portion for abutting against the bead top to retain the tapered surface portion vertically spaced from and above the can top.

13. The apparatus of claim 12 further characterized in that the punch portion is defined by an annular wall that along the axial length thereof and around the entire periphery is tapered inwardly in a downward direction to lock the punch portion to the can.

14. The apparatus of claim 12 further characterized in that the punch portion is annular and has a lower terminal cutting edge that has a first part that is of a minimum axial spacing from the tapered surface portion and a second part diametrically opposite the first part that is of a maximum spacing from the tapered surface portion, the cutting edge from the first part in both angular directions being first tapered downwardly at one angle to the vertical and thence at a smaller angle to the vertical.

15. The apparatus of claim 12 further characterized in that the first mentioned means has an annular guiding portion extending around the can below said bead and that the punch portion is annular and is in generally transverse centered relationship to the guiding portion with the guiding portion at least partially surrounding it.

16. An ash receiver device for a beverage can or the like that has a top beverage dispensing opening, comprising an annular mounting and guiding portion having an axially upper and an axially lowered terminal edge, said upper portion having a tapered cigarette holding slot, an annular punch portion having an upper portion and a lower tapered cutting edge, said cutting edge having a first part and a second part that is axially more remote from the punch portion upper portion than the cutting edge first part, and a mounting part extending between and joined to the guiding portion and the punch portion for mounting the punch portion on the guiding portion with the guiding portion surrounding at least the upper portion of the punch portion and spaced thereform, the punch portion and the mounting part having a bore extending therethrough, the mounting part having an upper surface surrounding said bore that is tapered downwardly toward said bore, said punch portion being defined by an annual wall that along the axial length thereof and around its periphery is tapered inwardly in a downward direction.

17. The apparatus of claim 16 further characterized in that the annular mounting and guiding portion has downwardly facing shoulder means for abutting against a can, said mounting part extending to a lower elevation than the shoulder means.

18. The apparatus of claim 16 further characterized in that the cutting edge from the first part in both angular directions is tapered downwardly at one angle to the vertical and thence at a substantially smaller angle to the vertical.

19. The apparatus of claim 16 further charactered in that the cutting edge throughout its angular length is tapered radially inwardly and upwardly.

20. The apparatus of claim 19 further characterized in that the punch portion is in generally transverse centered relationship to the mounting and guiding portion.

* * * * *

UNITED STATES PATENT AND TRADEMARK OFFICE

CERTIFICATE OF CORRECTION

PATENT NO. : 4,133,319
DATED : Jan. 9, 1979

INVENTOR(S) : Ellis L. Bloomfield

It is certified that error appears in the above-identified patent and that said Letters Patent are hereby corrected as shown below:

Column 3, line 9, "and" should read --the--.
Column 3, line 24, "in" should read --is--.

Signed and Sealed this

*Eighth* Day of *May 1979*

[SEAL]

*Attest:*

RUTH C. MASON
*Attesting Officer*

DONALD W. BANNER
*Commissioner of Patents and Trademarks*